US005155869A

United States Patent [19]

Ralli et al.

[11] Patent Number: 5,155,869

[45] Date of Patent: Oct. 20, 1992

[54] CONTOURED SHOULDER PAD WITH CLOSEABLE POCKET FOR VALUABLES

[76] Inventors: Mirianne M. Ralli, 300 E. 57th St., New York, N.Y. 10022; Alfred R. Dellay, 6620 Windsor La., Miami Beach, Fla. 33141

[21] Appl. No.: 738,869

[22] Filed: Aug. 1, 1991

Related U.S. Application Data

[63] Continuation-in-part of Ser. No. 616,243, Nov. 20, 1990.

[51] Int. Cl.[5] ..... A41D 27/26

[52] U.S. Cl. ..... 2/268; 2/247; 450/86

[58] Field of Search ..... 2/267, 268, 244, 338, 2/311, 312, 247, 248, 249, 250, 251; 450/86

[56] References Cited

U.S. PATENT DOCUMENTS

| | | | |
|---|---|---|---|
| 1,136,727 | 4/1915 | Smith | 450/36 |
| 2,415,698 | 2/1947 | Kreisberg | 2/268 |
| 2,416,415 | 2/1947 | Stehlik | 2/268 |
| 2,423,498 | 7/1947 | Hull | 2/268 |
| 2,497,808 | 2/1950 | Zacks | 2/268 |
| 2,497,992 | 2/1950 | Jacques | 2/268 |
| 2,532,059 | 11/1950 | Dee | 2/268 |
| 2,534,513 | 12/1950 | Gerry | 2/268 |
| 2,624,885 | 1/1953 | MacManus | 2/268 |
| 2,640,993 | 6/1953 | Kleinman | 2/268 |
| 2,665,429 | 1/1954 | Jurich | 2/268 |
| 2,671,223 | 3/1954 | Axsom | 2/268 |
| 4,704,745 | 11/1987 | Reaver | 2/268 |
| 4,764,988 | 8/1988 | Reaver | 2/268 |
| 4,945,576 | 8/1990 | Melton | 2/268 |

FOREIGN PATENT DOCUMENTS

| | | | |
|---|---|---|---|
| 905361 | 1/1954 | Fed. Rep. of Germany | 2/268 |
| 8602646 | 10/1986 | Netherlands | 2/268 |

*Primary Examiner*—Werner H. Schroeder
*Assistant Examiner*—Jeanette E. Chapman
*Attorney, Agent, or Firm*—Martin Smolowitz

[57] ABSTRACT

A shoulder pad configured and sized to dwell on the shoulder of a wearer; the shoulder pad includes an outer cover having upper and lower sheet portions which are folded over and stitched together so as to enclose a resilient core layer, and has an opening into a pocket provided within the core layer so that valuable articles may be placed therein for safekeeping. The pad also has lip portions provided at the pocket opening which are reinforced and include fasteners, such as VELCRO TM fastener strips, to close the pocket. The pad upper surface is provided with at least one VELCRO TM patch fastener or strip to engage the inside of the shoulder zone of a garment of a wearer to maintain the pad in desired position, and the pad lower surface includes a loop which can be opened and closed to embrace a brassiere strap of a wearer of the pad.

14 Claims, 3 Drawing Sheets

CONTOURED SHOULDER PAD WITH CLOSEABLE POCKET FOR VALUABLES

This is a continuation-in-part of application Ser. No. 07/616,243, filed Nov. 20, 1990.

BACKGROUND OF INVENTION

This invention relates to a contoured shoulder pad for attachment to a garment of a wearer, the pad having a closeable inner pocket in which valuable articles may be kept securely.

It is quite common for shoulder pads to be included in garments, especially women's garments. Examples of such shoulder pads are disclosed by U.S. Pat. No. 2,423,498 to Hull; U.S. Pat. No. 2,458,646 to Root; U.S. Pat. No. 2,501,640 to Woodward; U.S. Pat. No. 2,532,059 to Dee; U.S. Pat. No. 2,534,513 to Gerry; U.S. Pat. No. 2,624,885 to MacManus; U.S. Pat. No. 2,640,993 to Kleinman; and U.S. Pat. No. 2,671,223 to Axsom. Although such known shoulder pads have been made attachable to an inner shoulder surface of garments and onto brassiere straps, and have included core members, such shoulder pads have not provided an accessible inner pocket which is conveniently closeable for the purpose of securely keeping small articles such as credit cards, keys, money and such. Our invention provides a composite contoured pad having a folded semi-elliptical shape and an inner core which contains a closeable pocket, and is an appreciable improvement over known shoulder pads.

SUMMARY OF THE INVENTION

The present invention provides a contoured shoulder pad which is adapted to be comfortably positioned on each shoulder of a wearer and attached securely to a garment, such as to the inner surface of an outer garment such as a dress or shirt within its shoulder zone, or attached onto a brassiere strap of a wearer. The shoulder pad has a semi-elliptical concave shape and consists of an outer sheet of a woven fabric material which is folded over to enclose an inner resilient core member, and is stitched together so as to have one substantially straight edge and an elongated arcuate shaped edge, with the peripheral stitching being provided along the curved edge portion of the pad. The core member contains a closeable pocket which is made generally rectangular-shaped and includes a mouth opening and closure means provided adjacent the pad curved end, thus allowing small valuable articles such as cash, credit cards, keys, and the like to be stored safely in the pocket. The shoulder pad further includes attachment means located on its upper side for connecting it into the shoulder zone of an outer garment, or attachment means provided on the pad lower side for connecting it onto a brassiere strap of a wearer, or both, so that the pad is reliably and comfortably maintained in place on each shoulder of the wearer and yet provides convenient access to the pad inner pocket.

According to the present invention, the shoulder pad utilizes an outer fabric sheet which initially has an elliptical shape and an arcuate contoured profile, and is folded over along a central transverse line and stitched together along its curved edge so as to enclose the resilient core member, with the pocket opening being disposed adjacent the pad opposite or curved end. Attachment means such as VELCRO TM fastener strips are provided on the upper and lower surface of the shoulder pad and serve to position it in place, i.e. the Velcro TM strip (s) on upper side of the pad adhere to the inner surface of an outer garment such as a blouse, and Velcro strip(s) on the pad lower side are attached onto a bra strap on the shoulder of the wearer.

The pad outer flexible fabric material which is folded over and stitched together along its curved edge and covers a resilient and pliable inner core member made of a fibrous non-woven or flexible foam material, which forms the bulk of the pad. The pocket provided in the inner core member is preferably lined with a fabric material which is smooth and somewhat stronger than the core material. The pad is constructed with stitching provided along its curved end portion, and also along sides of the pocket so as to provide structural integrity to the pad. The pocket opening provided adjacent the curved end of the pad includes an under-cut surface which is spaced slightly back from the pad curved end, so as to allow the pad to be contoured and shaped and be sufficiently pliable to form a smooth contour with the shoulder of a wearer. The top of the pad has an overlapped curved end surface which permits a wearer to grip the pad with one hand and insert one or more fingers of the other hand into the pocket opening. By moving the pad lower lip downwardly, access is made to the pocket so as to permit its contents to be withdrawn. The opening for the pad pocket is held closed by fastening means such as snaps or VELCRO TM fastener strip(s) which are sufficiently strong to retain securely the pocket contents.

In summary, the shoulder pad containing an inner pocket is positioned on the shoulder of a wearer, with the pocket being accessible from adjacent the neck of the wearer, so as to permit easy opening of the pocket for removal of contents and then closing the pocket. The pad is shaped to be used as a conventional shoulder pad that contours well with the shoulder and outer garment of a wearer. The pocket opening is positioned spaced away slightly from the curved end portion of the pad, to allow the contents of the pocket to be protected and yet retain the general smooth contour of the pad.

It is a general object of this invention to provide an improved shoulder pad which is adapted to be retained on the garment of a wearer, and also have an inner closeable pocket adapted for safe storage for small articles therein, and which is simple and inexpensive to manufacture. It is a further object of the invention to provide a shoulder pad in which its curved contour shape is provided by the folded over construction of the outer cover which shapes the resilient inner core member.

BRIEF DESCRIPTION OF DRAWINGS

The invention will now be described with reference to the following drawings, in which.

DESCRIPTION OF INVENTION

Figure 2:
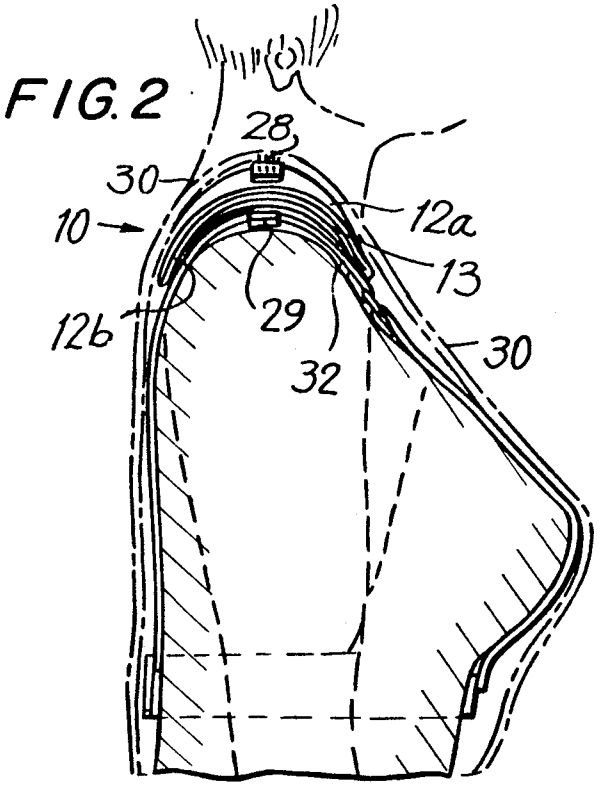
FIG. 2 shows an elevation view taken at a plane indicated by line 2—2 of FIG. 1 and looking outwardly in the direction of the arrows according to another use of the invention.
Figure 1:
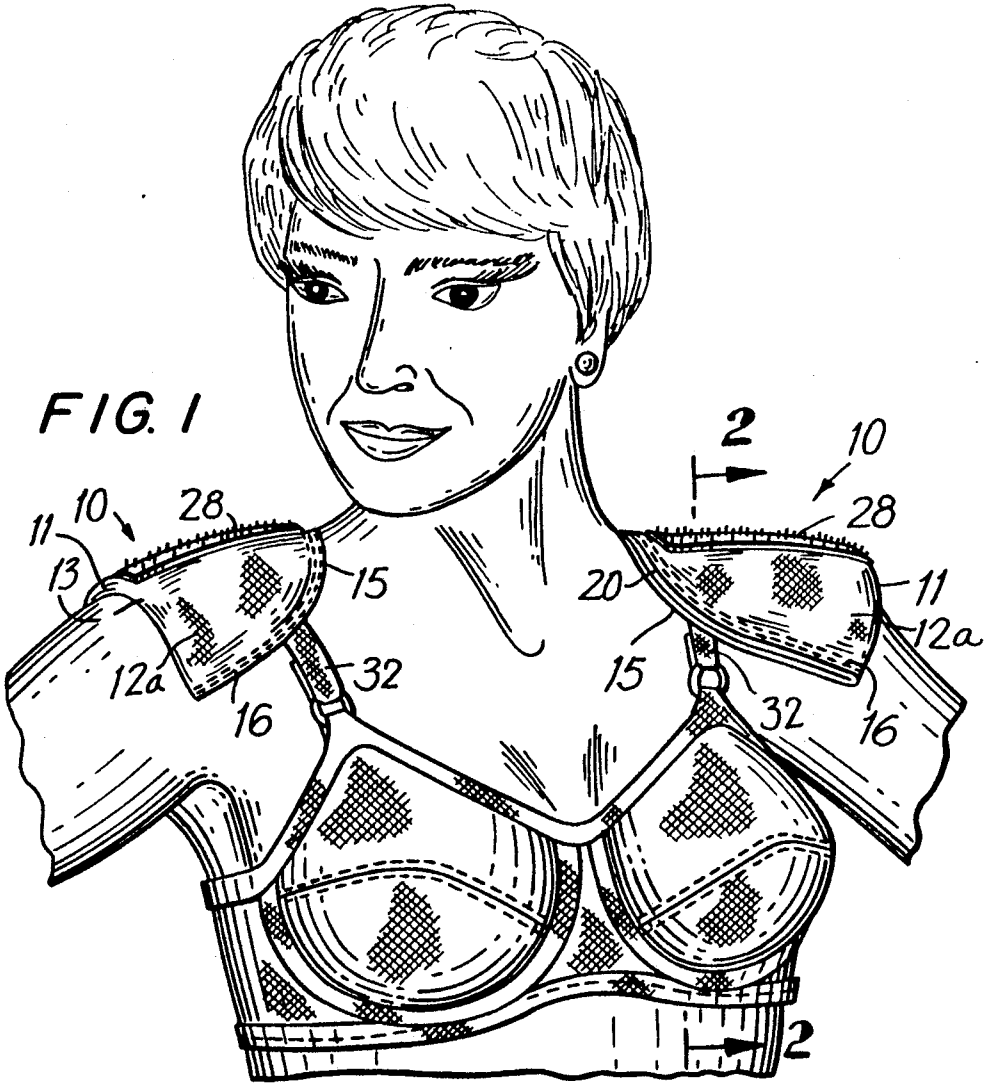
FIG. 1 is a perspective view illustrating one use of the shoulder pad by a wearer according to the invention.

This invention will now be further described by reference to the drawings in which like numerals are utilized to designate similar parts and portions of the shoulder pad. As generally shown by FIGS. 1 and 2, the shoulder pad 10 is configured and sized to dwell and fit on at least one and usually each shoulder of a wearer. The pad 10 has a concave semi-elliptical shape and includes an upper sheet portion 12*a* and a lower sheet portion 12*b*, which is folded over along edge 11 to enclose a resilient core member 13. The lower sheet portion 12*b* has an outer main surface which confronts the shoulder of a wearer, and the upper sheet portion 12*a* has an outer main surface facing oppositely of the outer main surface of the lower sheet portion 12*b*. These sheet portions 12*a* and 12*b* are generally congruent and each has an inner surface which face one another and are folded over at substantially straight edge or end 11 to retain the resilient core member 13, which is thickest in its central portion and tapers to be thinner towards the curved sides and end 15. The pad 10 layers are retained together by stitching 16 located peripherally about the pad outer edges along the two curved side edges and end 15, which stitching connects together the upper and lower sheet portions 12*a* and 12*b* so as to retain the resilient core layer 13.

Figure 3:
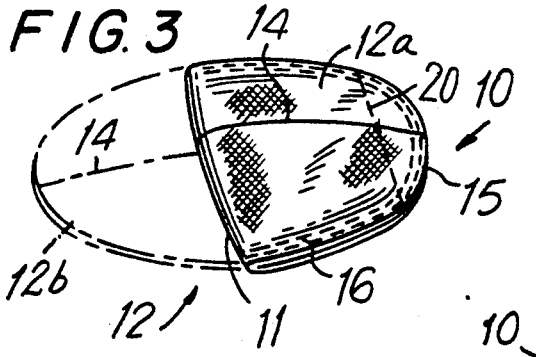
FIG. 3 shows a perspective view of the shoulder pad according to the invention, showing how the pad elliptical-shaped cover sheet is also made concave-shaped and is folded and stitched over an inner core member.
Figure 4:
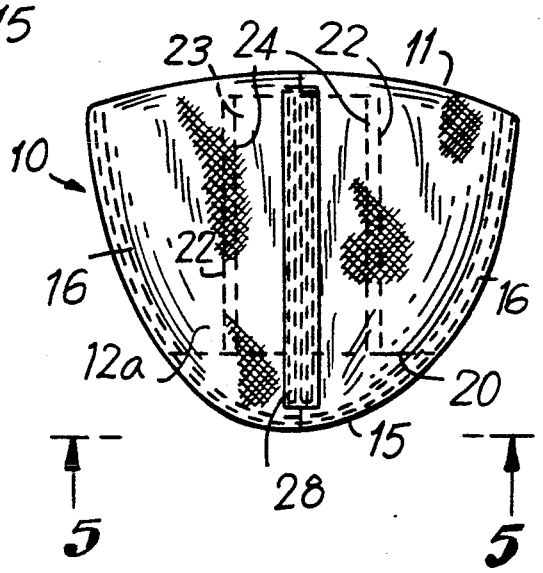
FIG. 4 is a top plan view of the shoulder pad showing location of the closeable pocket and attachment means.
Figure 5:
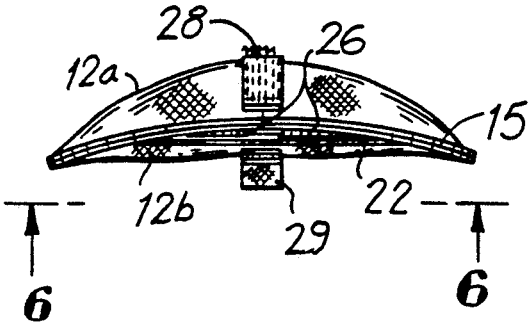
FIG. 5 is an elevation view taken at line 5—5 of FIG. 4.

As best shown by FIG. 3, the outer cover sheet 12 for the pad 10 is generally elliptical-shaped, and also has a concave-convex shape due to it being selectively drawn together more at each end before being joined together such as by stitching along central longitudinal seam 14. As one end portion 12*b* of the elliptical concave-convex shape cover 12 is folded along central transverse line to form edge 11 so as to be under upper sheet portion 12*a* and enclose the inner resilient layer 13 by utilizing stitching 16 located along the outer curved edge 15, it will be understood that the resulting pad 10 will assume a contoured semi-elliptical shape, as shown by FIGS. 1, 4 and 5.

Figure 6:
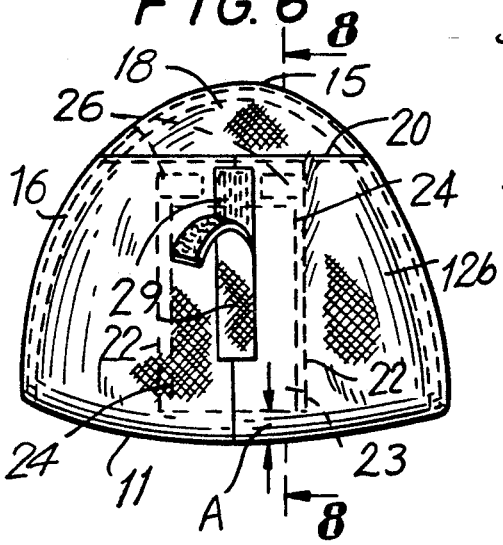
FIG. 6 is a bottom plan view of the shoulder pad showing the pocket opening and pad attachment means.
Figure 7:
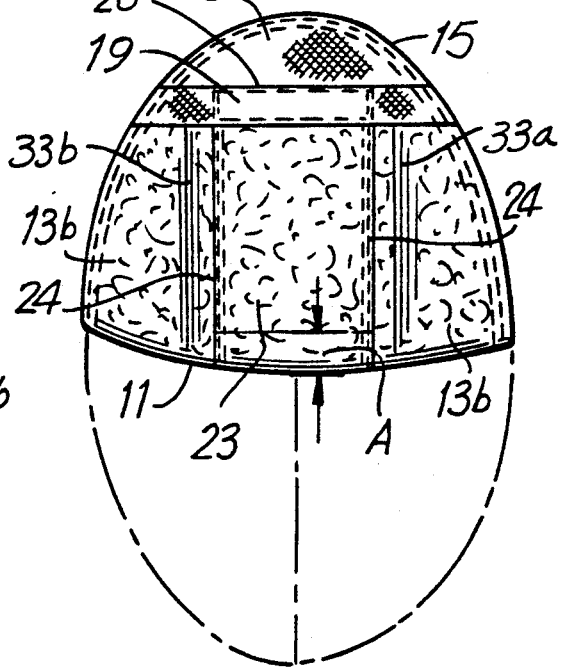
FIG. 7 is another bottom plan view of the shoulder pad showing one construction for the pocket, which can be opened or maintained in a closed position by suitable fastening means.

As shown by FIGS. 6 and 7, an inner segment-shaped transverse reinforcing strip 18 is provided stitched to the underside of curved end 15 of upper sheet 12*a*. Also, a lower transverse strip 19 is preferably stitched onto the under side of lower sheet 12*b*. These auxiliary strips or sheets provide reinforcement across the pad curved end 15. The auxiliary transverse strips 18, 19 also serve to define a mouth opening 20 between the two sheet portions 12*a* and 12*b* at the curved end 15 of the pad, which confronts the neck of a wearer as shown by FIG. 1. This mouth 20 leads into a pocket space 22, which is formed in resilient core member 13 by a centrally located slit therein and providing dual rows 24 of stitching which serves to define the longitudinal edges of pocket 22 formed in the resilient inner core member 13.

Figure 8:
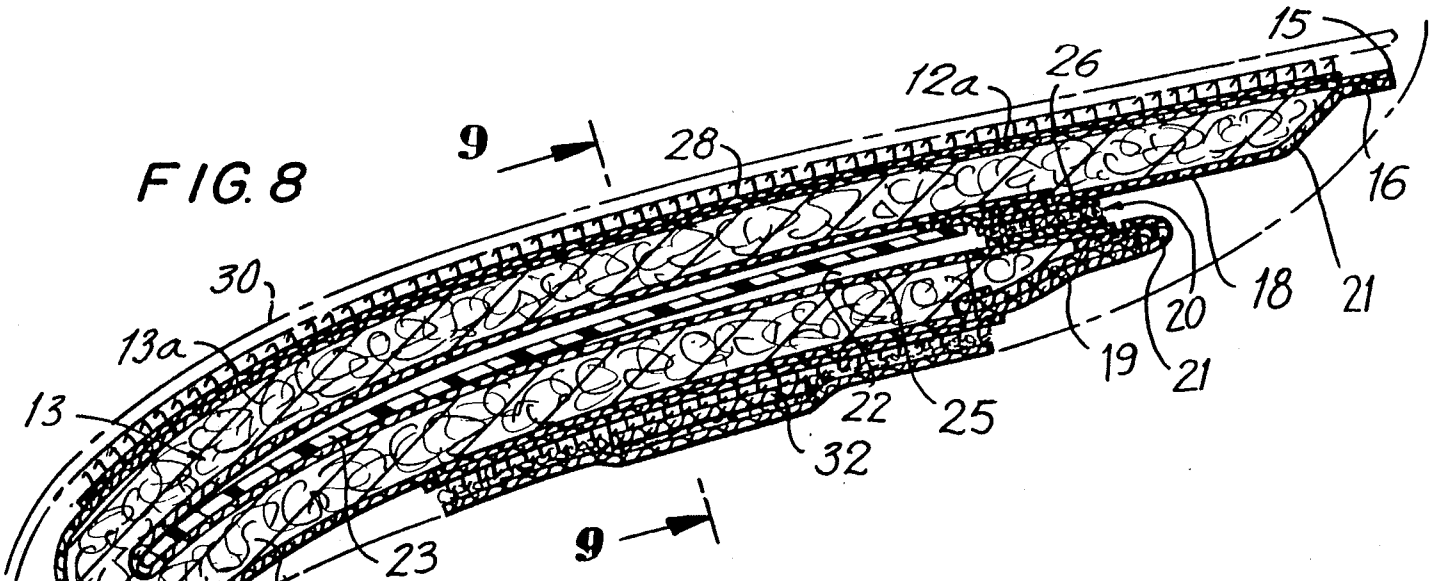
FIG. 8 shows an inverted cross-section view of the pad taken along line 8—8 of FIG. 6.
Figure 9:
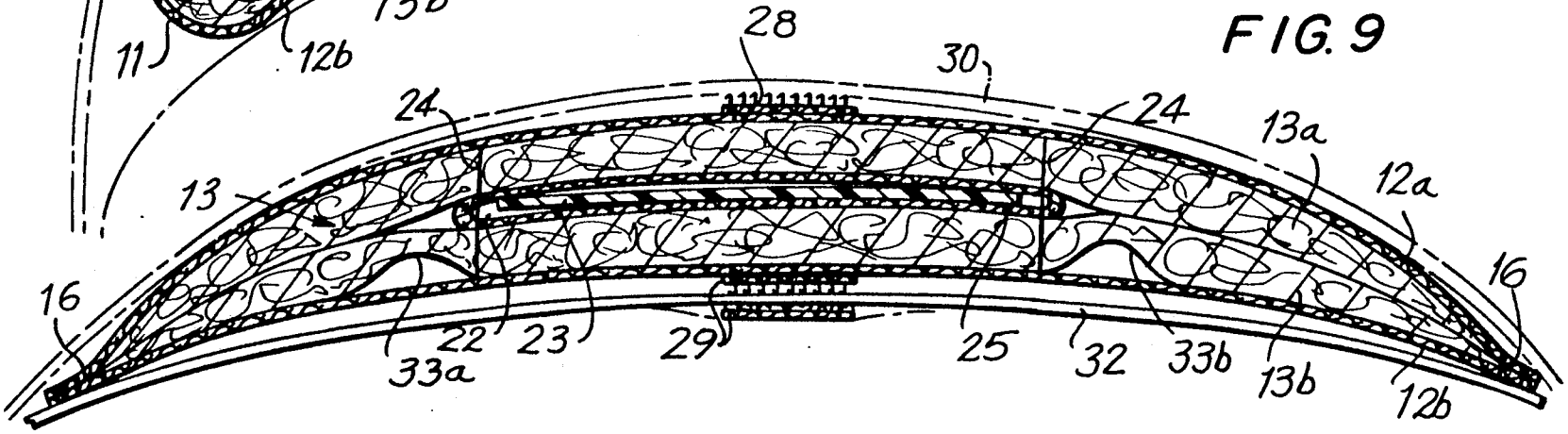
FIG. 9 shows a cross-sectional view of the pad taken along line 9—9 of FIG. 8.

As best shown by FIGS. 7, 8 and 9, the pocket 22 is preferably formed between two adjacent layers 13*a* and 13*b* of the resilient core material 13. If desired, upper layer 13*a* can be made smaller than lower layer 13*b* but slightly larger than pocket 22, and the two layers are attached together by stitching at 24 to form the pocket 22. The core lower layer 13*b* preferably has dual grooves or undercutting 33*a* and 33*b* provided therein on each outward side adjacent to stitching 24, to facilitate the smooth contouring of the core lower layer 13*b* to fit the shoulder curve of a wearer of the shoulder pad. Also, the pocket 22 is preferably lined with a smooth woven fabric material 25 such as nylon, rayon or polyester chiffon which has low frictional characteristics, which lining can not only determine the pocket depth but also permit easy insertion of articles 23 into and removal from the pocket 22. The pocket is sized to receive small articles 23 such as credit cards, keys, money or the like. As shown in FIGS. 6 and 7, dimension "A" should not extend closer than 0.3 inches of edge 11 of the pad 10, so as to avoid any contents 23 of the pocket 22 disturbing the smooth contour of the pad 10. The lips 21 of the opening mouth 20 are closeable by suitable fastening means 26, such as a small zipper or VELCRO TM fastener strips which are attached to the auxiliary transverse layers 18 and 19, with the latter fastener strips being preferred. The fastener means 26, which may be in the form of mutually interengageable VELCRO TM hook and eyelet fastener means, are adapted to be grasped by the fingers of a wearer for the purpose of opening and closing the mouth opening 20 leading into the pocket 22. The two mating lip portions 21 along the curved edge 15 are flexible and adapted to allow the pad 10 to conform to the natural contour of the shoulder of a wearer.

In one embodiment of the invention, there is provided on the upwardly facing surface of the cover sheet 12*a* at least one strip 28 of VELCRO TM hook and eyelet fastener means, which is adapted to adhere to the inner surface of the shoulder zone of an outer garment 30 when worn over the shoulder pad 10. Also in a preferred embodiment, the lower sheet 12*b* of the pad 10 is provided with a loop 29 which is adapted to be opened and closed so as to embrace a brassiere strap 32 of a wearer, as is additionally shown in FIGS. 8 and 9.

In use, it is seen that a person desiring to wear the shoulder pads 10 of the instant invention may simply attach each shoulder pad to a shoulder strap 32 of a brassiere. If a brassiere is not worn, the shoulder pad 10 can be positioned on the each shoulder of a wearer so that the upper VELCRO TM fastener strip 28 will be attached onto the inside surface of the shoulder zone of a shirt 30, for example. Articles 23 may be maintained in safekeeping in the pocket 22 provided within resilient core 13 between the shoulder pad upper and lower sheet portions, by inserting the article through the mouth 20 and into the pocket 22, then fastening the pocket closed using the Velcro fastener means 26, as shown by FIGS. 6, 7, and 8.

The shoulder pad outer sheet is made of flexible woven fabric, such as cotton, nylon or polyester material. The resilient inner core layer may be a non-woven fibrous material such as blown and heat bonded fibers such as polyester, or may be a flexible resilient foam material such as sponge rubber or flexible plastic material. All materials are selected so that the pad can withstand multiple washings to maintain its cleanliness. The shoulder pad outer dimensions can be varied so as to suit the size of the wearer, and will usually have overall length of 4–6.5 inches, width of 3–6 inches, overall height of 1–2 inches and thickness of 0.5–1 inch. The pocket size should be at least 2.3 inches wide and 3.5 inches deep so as to receive credit cards.

This invention will be further described by an Example of a typical shoulder pad, which example should not be construed as being limiting in scope.

EXAMPLE

A shoulder pad is constructed according to this invention utilizing an inner core member of non-woven fibrous polyester material, which is covered on its upper and lower sides by a woven polyester fabric sheet material. The fabric outer sheet is folded over the core member along one end of the pad, and it is stitched together along its curved side edges to form a generally curved semi-elliptical shaped shoulder pad. A rectangular-shaped pocket is provided within the core member, and is lined by a smooth woven polyester material. The pocket mouth opening is reinforced by transverse fabric strips, and is closeable by VELCRO TM fastener strips. A strip of Velcro TM is provided longitudinally along the upper and lower surfaces of the pad, and serves to attach the pad onto either the inner surface of the blouse, or onto a shoulder strap of a brassiere, or onto both. Important parameters of the shoulder pad are as follows:

| | |
|---|---|
| Pad overall length, in. | 5 |
| Pad maximum width, in. | 6 |
| Pad overall heiqht, in. | 1.5 |
| Pad overall thickness, in. | 0.60 |
| Pocket lenqth, in. | 3.5 |
| Pocket width, in. | 2.3 |

While this invention has been shown and described broadly and also in a practical and preferred embodiment, it is recognized that modifications and variations can be made within the spirit and scope of this invention, which should not be limited except as defined by the following claims.

What we claim is:

1. A shoulder pad configured and sized to dwell on the shoulder of a wearer, said pad comprising an elliptical-shaped outer sheet which is folded over to provide an upper sheet portion and a lower sheet portion which enclose therebetween a resilient inner core member, said lower sheet portion having an outer surface adapted to confront the shoulder of a wearer, said upper and lower sheet portions being generally congruent and each having an inner surface facing one another and said inner core member, said pad being semi-elliptical shape having a substantially straight edge and an outer curved edge, said pad including peripheral fastening means located adjacent the curved edge, said core member containing a pocket having a mouth opening provided between the upper and lower sheet portions and adjacent the curved edge and leading into the pocket which is centrally located in said core member, said pocket being defined by longitudinal stitching through said core member and having dimensions smaller than the core member and having closure means so as to receive small articles for storage therein, said pad having fastening means for retaining it on the shoulder of a wearer.

2. A shoulder pad as defined by claim 1, wherein said outer sheet includes two portions joined together by a longitudinal seam, so as to impart a convex shape to the upper sheet portion and a concave shape to the lower sheet portion of the pad.

3. A shoulder pad as defined by claim 1, wherein said pocket is rectangular-shaped and is sized by stitching extending through the pad and along the longitudinal edges and end of the pocket.

4. A shoulder pad as defined by claim 1, wherein the inner surfaces of said closeable pocket are provided with mutually intercooperating fastening means located adjacent said mouth opening of the pocket to releasably close the mouth opening of the pocket.

5. A shoulder pad as defined by claim 4, wherein said mutually intercooperating fastening means comprises hook and eyelet type fasteners.

6. A shoulder pad as defined by claim 1, wherein said resilient inner core member is formed by first and second adjacent layers which are attached together by stitching, said pocket being formed between said first and second core layers.

7. A shoulder pad as defined by claim 1, wherein said pocket within said resilient inner core member is lined with a smooth woven fabric material attached to the core member.

8. A shoulder pad as defined by claim 1, wherein said pocket extends to within 0.3–0.6 inches of the pad folded edge.

9. A shoulder pad as defined by claim 1, which includes at least one longitudinally extending generally centrally located hook and eyelet type fastener strip extending at least part way along the outer surface of said upper sheet portion between the pad outer edges, so as to confrontingly engage the under side of the shoulder zone of a garment worn by a wearer of the pad.

10. A shoulder pad as defined by claim 1, wherein the outer surface of said lower sheet portion includes releasable loop means adapted for opening to receive and for closing to embrace a shoulder strap of a brassiere of a wearer.

11. A shoulder pad as defined by claim 1, wherein the pocket mouth opening is located adjacent the neck of a wearer.

12. A shoulder pad as defined by claim 9, wherein the main surface of said lower sheet portion which confronts the shoulder of a wearer includes releasable loop means adapted for opening to receive and for closing to embrace the shoulder strap of a brassiere of a wearer.

13. A shoulder pad as defined by claim 6, wherein said core lower second layer has grooves provided adjacent and outwardly from the stitching.

14. A shoulder pad configured and sized to dwell on the shoulder of a wearer, said pad comprising an elliptical-shaped outer sheet of woven fabric which is folded over to provide an upper sheet portion and a lower sheet portion which enclose therebetween a resilient inner core member, said lower sheet portion having an outer surface adapted to confront the shoulder of a wearer, said upper and lower sheet portions being generally congruent and each having an inner surface facing one another and said inner core member, said pad being semi-elliptical shaped and having a substantially straight edge and an outer curved edge, said pad including peripheral fastening means located adjacent the outer curved edge, said core member containing a closeable pocket having a mouth opening provided between the upper and lower sheet portions and adjacent the curved edge and leading into the pocket provided in said core member, said pocket being rectangular-shaped and defined by dual longitudinal rows of stitching through the core member and containing a lining so as to receive small articles for storage therein, said pad including a longitudinally extending generally centrally located hook and eyelet type fastener means strip extending at least part way along the outer main surface of said upper sheet portion between the pad inner and outer edges, so as to confrontingly engage the under side of the shoulder zone of a garment worn by a wearer.

* * * * *